US010811825B2

(12) United States Patent
Bustos Heredia

(10) Patent No.: US 10,811,825 B2
(45) Date of Patent: Oct. 20, 2020

(54) SURFACE MOUNTED HDMI CONNECTOR

(71) Applicant: Würth Elektronik eiSos GmbH & Co. KG, Waldenburg (DE)

(72) Inventor: Jairo Bustos Heredia, Waldenburg (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 0 days.

(21) Appl. No.: 16/090,421

(22) PCT Filed: Apr. 11, 2017

(86) PCT No.: PCT/EP2017/058609
§ 371 (c)(1),
(2) Date: Oct. 1, 2018

(87) PCT Pub. No.: WO2017/182321
PCT Pub. Date: Oct. 26, 2017

(65) Prior Publication Data

US 2019/0123492 A1 Apr. 25, 2019

(30) Foreign Application Priority Data

Apr. 20, 2016 (DE) ..... 20 2016 002 696 U

(51) Int. Cl.
*H01R 24/60* (2011.01)
*H01R 13/66* (2006.01)
(Continued)

(52) U.S. Cl.
CPC ..... *H01R 13/665* (2013.01); *H01R 12/707* (2013.01); *H01R 13/6658* (2013.01); *H01R 24/60* (2013.01); *H01R 2107/00* (2013.01)

(58) Field of Classification Search
CPC ..... H01R 12/72; H01R 12/712; H01R 12/70; H01R 12/714; H01R 24/60; H01R 13/68;
(Continued)

(56) References Cited

U.S. PATENT DOCUMENTS 6,896,536 B1 5/2005 Nguyen et al.
8,206,177 B2 * 6/2012 Chang ..... H01R 13/502 439/607.35

(Continued)

FOREIGN PATENT DOCUMENTS

CN 202856099 4/2013
CN 203466312 3/2014

(Continued)

OTHER PUBLICATIONS

Translation of Japanese Office Action for JP Application 2018-555254 dated Jan. 17, 2020; 6 pages.

*Primary Examiner* — Vanessa Girardi
(74) *Attorney, Agent, or Firm* — Boyle Fredrickson, S.C.

(57) ABSTRACT

A plug connector for data transmission, in particular an HDMI socket, is configured to include a housing, which is open at least on one side, for the insertion of a matching further plug connector, in particular an HDMI plug. The plug connector further includes a printed circuit board, which is arranged within the housing and has contact areas for the matching further plug connector, and electronic components for signal processing and/or signal conditioning, which components are arranged on the printed circuit board, wherein the side edges of the printed circuit board are received, at least in sections, in groove guides of the housing.

7 Claims, 3 Drawing Sheets

(51) Int. Cl.
*H01R 12/70* (2011.01)
*H01R 107/00* (2006.01)

(58) Field of Classification Search
CPC ..... H01R 13/70; H01R 13/6608; H01R 13/6581; H01R 13/6594; H01R 13/6658; H01R 13/719
See application file for complete search history.

(56) References Cited

U.S. PATENT DOCUMENTS

| | | | | |
|---|---|---|---|---|
| 8,308,515 | B2 * | 11/2012 | Chang | H01R 27/02 439/660 |
| 8,460,036 | B1 | 6/2013 | Chen | |
| 9,992,863 | B2 * | 6/2018 | Amini | B23C 3/12 |
| 2006/0276064 | A1 | 12/2006 | Takimura et al. | |
| 2010/0124829 | A1 | 5/2010 | He et al. | |
| 2011/0111608 | A1 * | 5/2011 | Chen | H01R 12/724 439/78 |
| 2011/0136384 | A1 | 6/2011 | Chang | |
| 2011/0159735 | A1 | 6/2011 | Chang | |
| 2015/0229077 | A1 | 8/2015 | Little et al. | |
| 2015/0333435 | A1 | 11/2015 | Arai et al. | |
| 2016/0072206 | A1 | 3/2016 | LaPalme et al. | |

FOREIGN PATENT DOCUMENTS

| | | |
|---|---|---|
| CN | 203466375 | 3/2014 |
| DE | 102012023151 | 6/2013 |
| JP | 2014186819 | 3/2013 |

* cited by examiner

SURFACE MOUNTED HDMI CONNECTOR

BACKGROUND

Field of the Application

The invention relates to a plug connector for data transmission, in particular an HDMI socket, comprising a housing, which is open at least on one side, for the insertion of a matching further plug connector, in particular an HDMI plug, comprising a printed circuit board, which is arranged within the housing and has contact areas for the matching further plug connector, and comprising electronic components for signal processing and/or signal conditioning, which components are arranged on the printed circuit board.

Description of Related Art

U.S. Pat. No. 8,460,036 B1 discloses a plug connector comprising a housing, which is open on one side, for connection to a matching plug connector. A printed circuit comprising contacts and also electrical components, for example capacitors, coils or resistors, is arranged within the housing.

DE 10 2010 023 151 A1 describes an adapter comprising two different plug connectors in opposite end regions of the adapter. The plug connectors have printed circuit boards on which chips are integrated.

The objective of the invention is to simplify a plug connector for data transmission in respect of the structural design of said plug connector and in respect of mounting of said plug connector on a base printed circuit board.

SUMMARY

To this end, the invention provides a plug connector for data transmission, in particular an HDMI socket, comprising a housing, which is open at least on one side, for the insertion of a matching further plug connector, in particular an HDMI plug, comprising a printed circuit board, which is arranged within the housing and has contact areas for the matching further plug connector, comprising electronic components for signal processing and/or signal conditioning, which components are arranged on the printed circuit board, wherein side edges of the printed circuit board are received, at least in sections, in groove guides of the housing.

Since both contact areas for the matching further plug connector and electronic components for signal processing and/or signal conditioning and connection pins which extend to contact areas on the bottom side of the housing are arranged on the printed circuit board itself, the structural design of the plug connector is considerably simplified. This is because all of the contact areas and electronic components are arranged on a single printed circuit board. The plug connector can be designed with contact pins, which are inserted into bores in a printed circuit board, for THT (Through-Hole Technology) mounting or with contact areas on the housing for SMT (Surface-Mounted Technology) mounting. Since the groove guides for receiving the side edges of the printed circuit board are provided in the housing, the printed circuit board is guided in the housing during a mounting operation such that mounting is simplified. In addition, the printed circuit board is also held securely in the housing in the event of vibration or shock loads in the mounted state. The groove guides of the housing and the side edges of the printed circuit board can additionally be designed such that fail-safe mounting is provided, so that the printed circuit board can be inserted into the housing only in a structurally predetermined position.

In a development of the invention, the printed circuit board is held centrally in the housing by means of the groove guides.

The housing is advantageously at an equal distance from a top side and a bottom side of the housing, and therefore electronic components can be arranged both on a bottom side and on a top side of the printed circuit board.

In a development of the invention, the bottom side of the housing has at least one contact area which is not connected to the printed circuit board.

Contact areas or soldering areas can be provided on the bottom side of the housing, said areas not being provided for making electrical contact but rather solely for mechanically fastening the housing on the base printed circuit board. In this way, the contact areas can be positioned such that firstly effective and reliable electrical contact and secondly also secure mechanical connection of the housing to the base printed circuit board are ensured.

In a development of the invention, the housing is composed of electrically conductive material and is electrically connected to the at least one contact area.

An electrical connection is produced between the base printed circuit board and the housing as a result, so that the housing, for example, can be connected to ground and can have a shielding effect.

In a development of the invention, the printed circuit board is held substantially centrally in the housing, so that the printed circuit board can be surrounded in sections by the matching further plug connector when said plug connector is inserted into the housing.

As a result, contact can be made with the contact areas on the printed circuit board directly by the matching further plug connector. Additional contact springs, contact tracks or the like, which are designed as separate components, are avoided as a result. The printed circuit board can be guided, for example by way of its two longitudinal edges, in matching grooves of the housing.

In a development of the invention, the electronic components are arranged both on a top side and on a bottom side of the printed circuit board.

In this way, numerous electronic components can also be arranged in a space-saving manner on the printed circuit board and within the housing itself.

In a development of the invention, the contact areas for the matching further plug connector are arranged both on a top side and on a bottom side of the printed circuit board.

In this way, numerous contact areas for the matching further plug connector can also be accommodated on the printed circuit board.

In a development of the invention, the contact areas are formed by means of a conductive layer of the material of the printed circuit board or are formed on the basis of a conductive layer of the material of the printed circuit board.

This advantageously produces a compact design of the contact areas.

In a development of the invention, the housing has, on its bottom side, contact areas for the cohesive connection to contact areas of a base printed circuit board and is provided with electrically conductive connection pins which, starting from the printed circuit board, extend through the housing and to the contact areas on the bottom side of the housing.

This printed circuit hoard is then connected to the contact areas on the bottom side of the housing by means of the connection pins, so that the housing therefore merely has to be placed on matching mating contacts on a base printed circuit board and connected to said mating contacts in order to mount the plug connector. The plug connector according to the invention is therefore provided as a "surface-mounted device" for so-called SMD mounting in this embodiment. The plug connector according to the invention manages with a minimum number of components and can be fastened to a base printed circuit board in a simple and very secure manner.

BRIEF DESCRIPTION OF THE DRAWINGS

Further features and advantages of the invention can be found in the claims and the following description of a preferred embodiment of the invention in conjunction with the drawings, in which:

DETAILED DESCRIPTION

Figure 1:
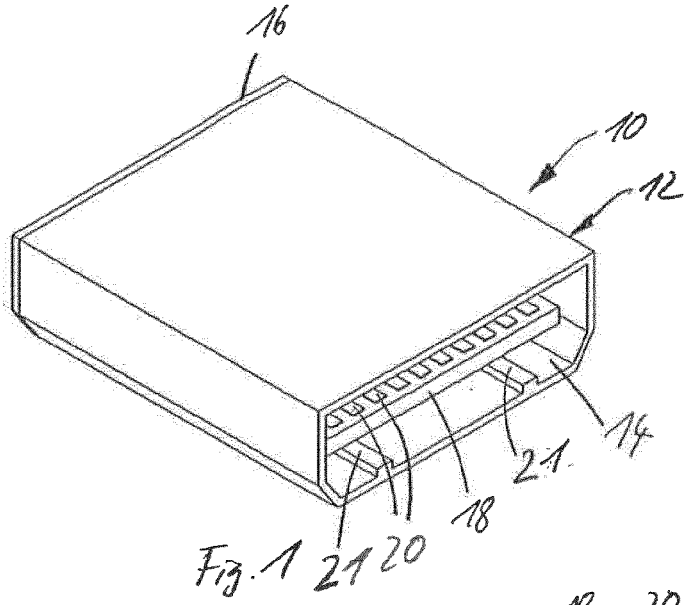
FIG. 1 shows a plug connector according to the invention in line with a first embodiment obliquely from above.

FIG. 1 shows a plug connector 10 according to the invention in line with a first embodiment. The plug connector 10 is in the form of an HDMI socket. The plug connector 10 has a housing 12 which, on its narrow side which is situated at the bottom right in FIG. 1, is provided with an opening 14. A rear side of the housing 12 is closed by means of a cover 16. The cover 16 can be dispensed with if the printed circuit board 18 protrudes beyond the housing 12, for example in order to be able to arrange additional electronic components on the printed circuit board 18. A printed circuit board 18 is arranged within the housing, said printed circuit board being arranged approximately halfway up the housing and, in certain sections, by way of its side edges, also see FIG. 2, being at a distance from the side walls of the housing. In any case, the printed circuit board 18 can in this way be surrounded, in its region which adjoins the opening 14, by a matching further plug connector which is inserted into the housing 12, especially an HDMI plug. As a result, the contact areas 20, which are shown only on the top side of the printed circuit board 18 in FIG. 1, can then be electrically connected to the corresponding contacts of the HDMI plug. FIG. 1 shows a total of ten contact areas 20 on the top side of the printed circuit board 18, said contact areas each being in the form of a strip and being arranged next to one another.

A further nine contact areas 22 are arranged on the bottom side of the printed circuit board, as will be explained further and is shown in the further figures.

The housing 12 has, on its inner side, two guide bars 21 which, when an HDMI plug is mounted onto the printed circuit board 18, guide said HDMI plug and position said HDMI plug within the opening 14 in the housing 12.

Figure 2:
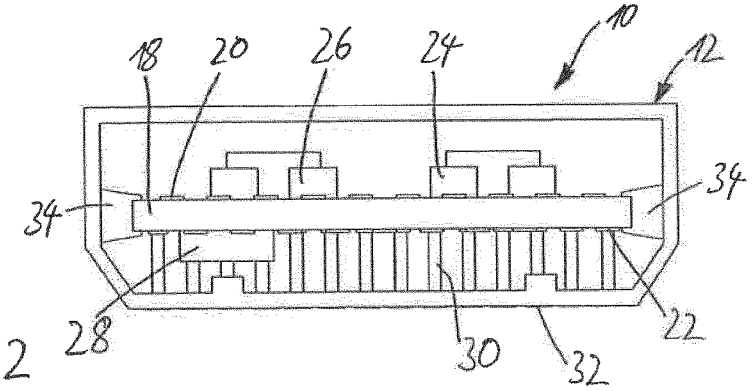
FIG. 2 shows the plug connector of FIG. 1 from the front.

The illustration of FIG. 2 shows a view of the plug connector 10 from the front. The housing 12 has a generally rectangular cross-sectional shape, wherein the two longitudinal edges which are situated at the bottom are each beveled. As a result, the housing 12 complies with the HDMI standard and is suitable for receiving an HDMI plug with an accurate fit.

The illustration of FIG. 2 shows that the printed circuit board 18 is provided with the total of ten contact areas 20 on its surface, and that said printed circuit board is provided with nine further contact areas 22 on its opposite bottom side. The contact areas 20 and 22 serve, as has already been discussed, for making contact with contacts of a matching further plug connector, in the present case an HDMI plug.

In the view shown in FIG. 2, electronic components 24, 26 and 28 are shown on a top side and a bottom side of the printed circuit board 18.

FIG. 2 also shows a total of fourteen connection pins 30 which are connected at one end to conductor tracks on the printed circuit board 18 and at the other end to contact areas 32 on the bottom side of the housing 12. The connection pins 30 establish an electrical connection between the contact areas 32 and conductor tracks on the printed circuit board 18. Furthermore, the connection pins 30 serve as holding means for the printed circuit board 18 in order to thereby hold said printed circuit board in the illustrated position approximately centrally in the housing 12. The connection pins 30 do not represent the only holding means for the printed circuit board 18 in this case. For example, the housing 12 can be provided with groove guides 34 at the sides, said groove guides being only schematically illustrated and receiving the side edges of the printed circuit board 18 in sections. In this case, the groove guides 34 extend in each case only to such an extent along the side edges of the printed circuit board 18 that an HDMI plug can be inserted into the opening 14 in the housing 12 and can then surround the printed circuit board 18 both at the sides and also at the top and at the bottom by means of part of its length.

Figure 3:
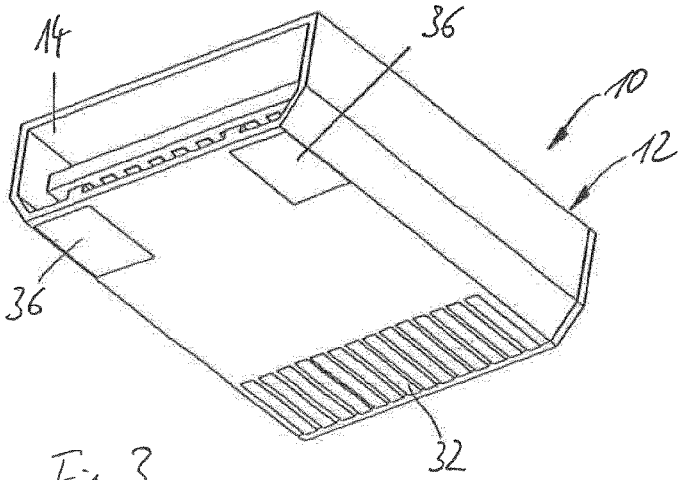
FIG. 3 shows the plug connector of FIG. 1 obliquely from below.

The illustration of FIG. 3 shows the plug connector 10 of FIG. 1 in a view obliquely from below. As has already been explained, the housing 12 is provided, on its bottom side, with a total of fourteen strip-like contact areas 32 which are provided for cohesive connection to matching contact areas of a base printed circuit board, not illustrated, and which ensure an electrical connection of the plug connector 10 to the base printed circuit board. As has already been explained, the connection pins 30 extend through the base wall of the housing 12 and as a result provide an electrical connection between the contact areas 32 and conductor tracks on the printed circuit board 18.

Two further contact areas 36 are likewise provided on the bottom side of the housing 12, but at the front side which adjoins the opening 14, said further contact areas being designed to be considerably larger than the individual contact areas 32. The contact areas 36 are provided solely for mechanically fastening of the housing 12 to the base printed circuit board and are not electrically connected to conductor tracks or contact areas on the printed circuit board 18. In the case of SMD mounting, the housing 12 can be mounted onto the base printed circuit board in a simple manner and then can be both electrically and mechanically connected to matching contact areas on the base printed circuit board by means of the contact areas 32, 36 in a very reliable manner.

In order to achieve as high a degree of mechanical stability of the connection of the housing 12 to the base printed circuit board as possible, the two contact areas 36 are arranged at the opposite end of the housing 12 on the bottom side of said housing and on the right-hand side and, respectively, left-hand side of the bottom side. The contact areas 32 and the contact areas 36 are therefore at the largest possible distance from one another and ensure stable mechanical fastening of the housing 12 on the base printed circuit board.

Figure 4:
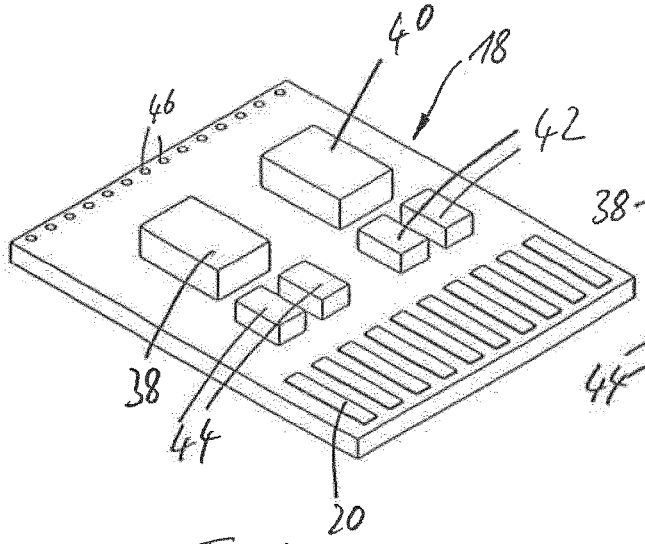
FIG. 4 shows the printed circuit board, which is arranged in the plug connector of FIG. 1, in a view obliquely from above.

The illustration of FIG. 4 shows the printed circuit board 18 in a view obliquely from above. The contact areas 20, of which a total of ten are provided on the top side, are clearly shown in this view. Electronic components 38, 40 and 42 and 44 are provided on the top side of the printed circuit board 18. By way of example, the components 38, 40 provide ESD protection, that is to say, are in the form of components which prevent electrostatic discharge when an HDMI plug is plugged in. The components 42, 44 are formed, for example, as inductors.

Figure 7:
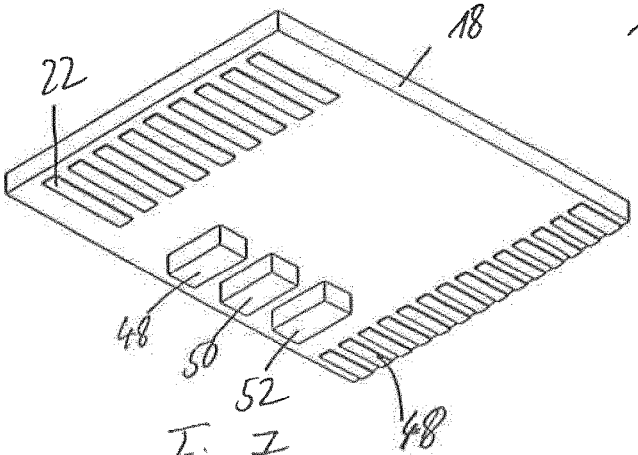
FIG. 7 shows the printed circuit board of FIG. 4 obliquely from below.

Plated-through holes 46 are shown on the rear edge of the printed circuit board 18, which rear edge is opposite the contact areas 20, said plated-through holes leading from the top side, shown in FIG. 4, of the printed circuit board 18 to the bottom side, illustrated in FIG. 7 for example, of the printed circuit board 18 and to the connection areas 48 shown there. The connection areas 48 are then in turn electrically and mechanically connected to the connection pins 30. By way of example, the connection areas 48 can each have passage openings which, in terms of their position, correspond to the plated-through holes 46 in order to electrically and mechanically connect the connection pins 30 securely to the printed circuit board 18.

Figure 5:
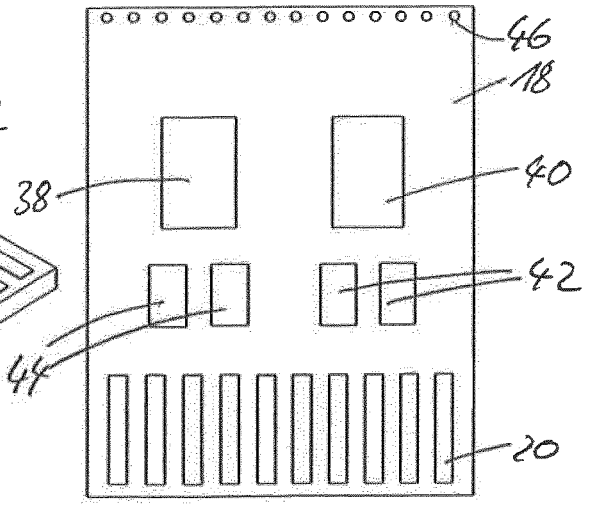
FIG. 5 shows the printed circuit board of FIG. 4 from above.

FIG. 5 shows a view of the printed circuit board 18 from above.

Figure 6:
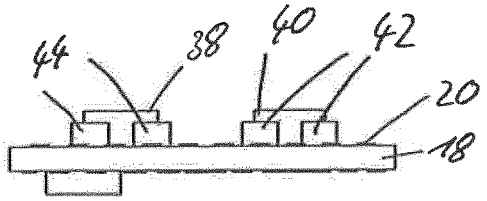
FIG. 6 shows the printed circuit board of FIG. 4 from the front.

FIG. 6 shows a view of the printed circuit board 18 from the front. Said figure shows that electronic components are also arranged on the bottom side of the printed circuit board 18, also see FIG. 7. These electronic components 48, 50, 52 are, like the electronic components 38, 40, 42, 44, connected to conductor tracks, not illustrated in the figures, on the top side and, respectively, bottom side of the printed circuit board 18. The electronic components 48, 52 are, for example, in the faun of capacitors, and the electronic component 50 is in the form of a coil, in particular in the form of a filter coil.

The contact areas 22 on the bottom side of the printed circuit board 18 are shown in the illustration of FIG. 7, said contacts areas serving for electrical connection to an HDMI plug, not illustrated. A total of nine contact areas 22 are shown on the bottom side of the printed circuit board 18.

Figure 8:
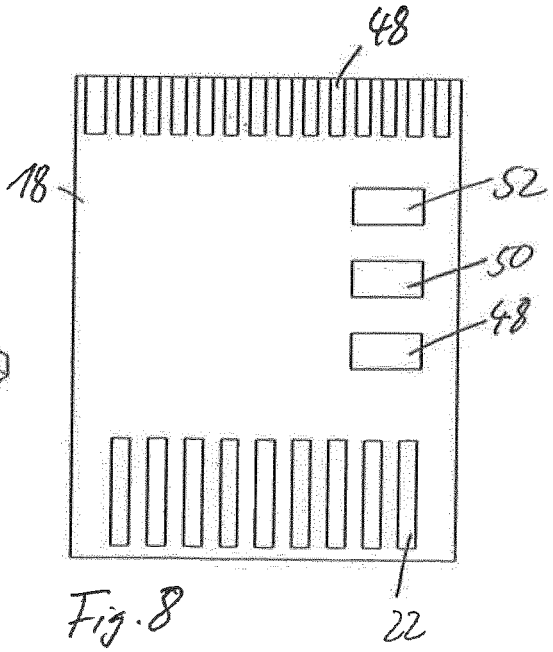
FIG. 8 shows the printed circuit board of FIG. 4 from below.

The illustration of FIG. 8 shows the printed circuit board 18 in a view from the bottom.

An extremely compact design can be achieved with the plug connector 10 according to the invention overall. All of the electronic components 38 to 52 are arranged on the integral printed circuit board 18. All of the contact areas 20, 22 which serve for electrical connection to a further, matching plug connector, especially to an HDMI plug, are also arranged on the printed circuit board 18. The printed circuit board 18 is arranged approximately centrally in the housing 12, so that it can be surrounded in sections by the matching further plug connector, especially an HDMI plug. Connection pins 30 ensure both electrical connection of the conductor track on the printed circuit board 18 to a bottom side of the housing 12, which bottom side is provided with contact areas 32, and the connection pins 30 furthermore also contribute to mechanically fastening the printed circuit board 18 in the housing 12.

Figure 9:
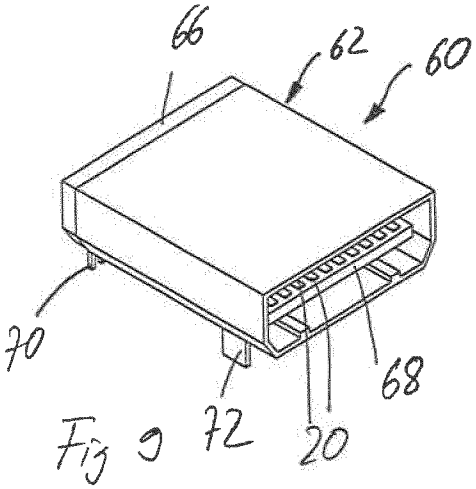
FIG. 9 shows a plug connector according to the invention in line with a second embodiment obliquely from above.

FIG. 9 shows a plug connector 60 according to the invention in line with a second embodiment of the invention obliquely from above. The plug connector 60 has a housing 62 which, in contrast to the housing 12 of the plug connector 10 of FIG. 1, is designed for so-called THT (Through-Hole Technology) mounting. To this end, the housing 62, in contrast to the housing 12 of the plug connector 10 of FIG. 1, has contact pins 70 which are inserted into matching bores in a printed circuit board and are then soldered. The contact pins 70 are connected to conductor tracks on the printed circuit board 68 and serve for electrical connection of the plug connector 60. Furthermore, plate-like fastening pins 72 which extend away from a bottom side of the housing 62 are provided. The fastening pins 72 do not serve for electrical connection but rather solely for mechanically connecting the housing 62 to a printed circuit board, not illustrated. The fastening pins 72 can be composed of metal. However, it is also possible within the scope of the invention for the fastening pins 72 to be integrally formed with the housing 62 from non-conductive plastic. In this case, the fastening pins 72 are then inserted into matching bores or recesses in the printed circuit board and then, for example, adhesively bonded or latched.

The printed circuit board 68 is substantially identical to the printed circuit board 18 of the plug connector 10 of FIG. 1. FIG. 9 shows contact areas 20 on the top side of the printed circuit board 68, which contact areas serve for electrical connection to a matching further plug connector, not illustrated.

FIG. 9 shows a cover 66 on the rear side of the housing, which rear side is averted from the viewer. This cover 66 closes off the housing 62 to the rear. Like the cover 16 in the case of the plug connector 10 of FIG. 1, the cover 66 can also be dispensed with in order to be able to extend the printed circuit board 18 and, respectively, 68 beyond the housing 62. This may be expedient and advantageous in order to be able to arrange, for example, additional electronic components on the printed circuit board 18, 68.

Figure 10:
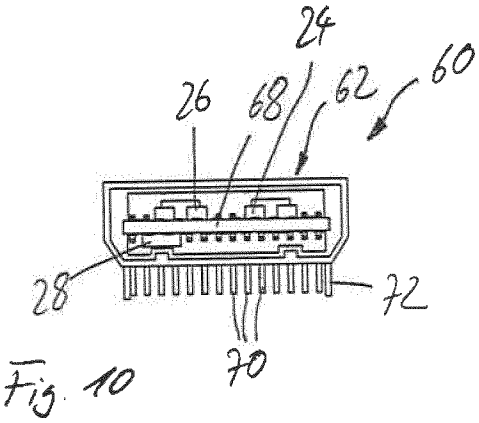
FIG. 10 shows the plug connector of FIG. 9 from the front.

The illustration of FIG. 10 shows the plug connector 60 in a view from the front. The fastening pins 72 and the contact pins 70 are clearly shown.

In the same way as the printed circuit board 18 of the plug connector 10 of FIG. 1, the printed circuit board 68 supports electronic components 26, 24 and 28 and is provided with the contact areas 20 on its top side, see FIG. 9, and with the contact areas 22 on the bottom side.

FIG. 10 shows that the printed circuit board 68 is arranged in the housing 62 such that the printed circuit board 68 projects freely in the region of the contact areas 20, 22 and as a result can be surrounded in sections by a matching HDMI plug.

Figure 11:
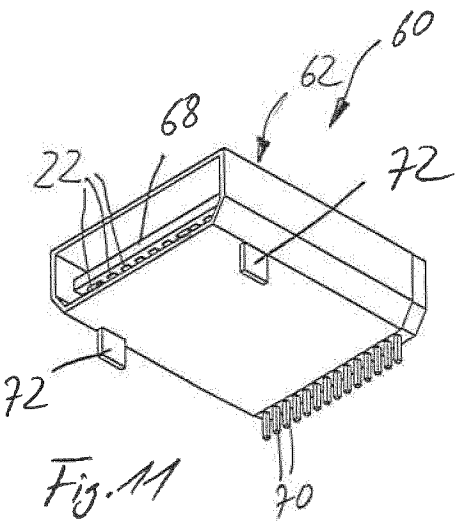
FIG. 11 shows the plug connector of FIG. 9 obliquely from below.

The illustration of FIG. 11 shows the plug connector 60 in a view obliquely from below. The contact pins 70 which project from a bottom side of the housing 62 are clearly shown in this view. As a result, the contact pins 70, together with the fastening pins 72, ensure mechanically very reliable fastening of the housing 62 to a printed circuit board, not illustrated. Furthermore, the contact pins 70 serve, as has already been explained, for electrical connection of the contact areas 20, 22 on the printed circuit board 68.

The invention claimed is:

1. A plug connector for data transmission, in particular an HDMI socket, comprising a housing, which is open at least on one side, for the insertion of a matching further plug connector, in particular an HDMI plug, the HDMI plug comprising a printed circuit board, which is arranged within the housing and has connector contact areas for the matching further plug connector, and comprising electronic components for signal processing and/or signal conditioning, which components are arranged on the printed circuit board, the housing including guide grooves configured to receive side edges of the printed circuit board a bottom side of the housing having at least one fastening contact area for connection and grounding to a second printed circuit board wherein the fastening contact area is electrically connected to the housing and the guide grooves and not electrically connected to the printed circuit board, wherein the housing is composed of electrically conductive material and is electrically connected to the at least one fastening contact area.

2. The plug connector as claimed in claim 1, wherein the printed circuit board is held centrally in the housing by means of the groove guides.

3. The plug connector as claimed in claim 1, wherein the printed circuit board is held substantially centrally in the housing, so that the printed circuit board can be surrounded in sections by the matching further plug connector when said plug connector is inserted into the housing.

4. The plug connector as claimed in claim 1, wherein the electronic components are arranged both on a top side and on a bottom side of the printed circuit board.

5. The plug connector as claimed in claim 1, wherein the connector contact areas for the matching further plug connector are arranged both on a top side and on a bottom side of the printed circuit board.

6. The plug connector as claimed in claim 1, wherein the connector contact areas are formed by means of a conductive layer of the material of the printed circuit board or are formed on the basis of a conductive layer of the material of the printed circuit board.

7. The plug connector as claimed in claim 1, wherein the housing has, on its bottom side, fastening contact areas for the cohesive connection to grounding contact areas of a base printed circuit board and is provided with electrically conductive connection pins which, starting from the printed circuit board, extend through the housing and to pin contact areas on the bottom side of the housing.

* * * * *